US007195492B2

(12) United States Patent
Schröer

(10) Patent No.: US 7,195,492 B2
(45) Date of Patent: Mar. 27, 2007

(54) ARRANGEMENT FOR SUPPLYING POWER TO LOADS WHICH ARE PROVIDED IN A MOTOR VEHICLE

(76) Inventor: Frank Schröer, St.-Michael-Strasse 8, D-92637 Weiden (DE)

( * ) Notice: Subject to any disclaimer, the term of this patent is extended or adjusted under 35 U.S.C. 154(b) by 0 days.

(21) Appl. No.: 11/314,744

(22) Filed: Dec. 21, 2005

(65) Prior Publication Data

US 2006/0160401 A1 Jul. 20, 2006

(30) Foreign Application Priority Data

Dec. 27, 2004 (EP) ..... 04293140

(51) Int. Cl.
*H01R 39/00* (2006.01)

(52) U.S. Cl. ..... 439/31; 439/165

(58) Field of Classification Search ..... 439/1, 439/11, 13, 31–32, 495, 165; 16/386
See application file for complete search history.

(56) References Cited

U.S. PATENT DOCUMENTS 3,857,625 A * 12/1974 Crane et al. ..... 439/31
5,681,176 A * 10/1997 Ibaraki et al. ..... 439/165
5,995,373 A * 11/1999 Nagai ..... 361/755
6,447,314 B1 * 9/2002 Kato et al. ..... 439/165
6,885,549 B2 * 4/2005 Thomason ..... 361/683
7,094,084 B2 * 8/2006 Lee ..... 439/165
2002/0112320 A1 * 8/2002 Hyashi ..... 16/386

FOREIGN PATENT DOCUMENTS

JP 000479567 A1 * 2/1991
JP 08048146 * 2/1996

* cited by examiner

*Primary Examiner*—Michael C. Zarroli
(74) *Attorney, Agent, or Firm*—Sofer & Haroun, LLP

(57) ABSTRACT

An arrangement for supplying power to loads provided in a motor vehicle, in which at least two units of electrical lines are combined, is disclosed. The lines are connected to both a voltage source and a load at each end. The loads are provided both on the body of the motor vehicle and on at least one pivoting part, such as a door. A contact carrier having a number of contact elements, which are isolated from one another and are made from a conductive and resilient material, is provided in the region of the axis of rotation, it being possible for this contact carrier to follow a pivoting movement of the moving part, while maintaining the electrical connection between the voltage source and the loads. The wire shaped contact elements are designed as helices having at least one turn, and have mating contacts on each end.

3 Claims, 2 Drawing Sheets

ARRANGEMENT FOR SUPPLYING POWER TO LOADS WHICH ARE PROVIDED IN A MOTOR VEHICLE

RELATED APPLICATION

This application is related to and claims the benefit of priority from European Patent Application No. 04 293 140.2, filed on Dec. 27, 2005, the entirety of which is incorporated herein by reference.

FIELD OF THE INVENTION

The invention relates to an arrangement for supplying power to loads.

BACKGROUND

So-called cable harnesses are used in known techniques to connect electrical loads of a motor vehicle, which may be a passenger car or a heavy goods vehicle, to a battery which is present in the said motor vehicle as a voltage source. In cable harnesses of this type, a more or less large number of electrical lines are combined to form one unit. The lines may be of different lengths depending on the size of the distances to be covered between the battery and/or the controller on the one hand and the loads on the other. The greater the number of loads to be connected, the more complex are the cable harnesses and, correspondingly, installation. For the sake of simplicity, the word "car" is used in place of the word "motor vehicle" in the following text.

Loads in a car include, for example, the incandescent bulbs in headlamps and rear lights, motors for adjusting the mirrors, for opening and closing windows, and for seat—adjustment systems, seat heaters, a steering-wheel heating system, lamps on the dashboard and the number plates, and sensors and controllers. No particular problems arise provided that the loads are mounted on or in the body of a car. This is not the case when the loads are located on or in a moving part of the car. In this case, "moving parts" are all of the doors of the car, but especially particularly a door which is designed as a tailgate. For the sake of simplicity, the word "door" is used in place of the word "moving part" in the text which follows. Each door is connected to the body of the car such that it can pivot about an axis of rotation. The lines which lead to the loads which are provided on or in the door are bent to and fro each time the door moves. They are thus permanently mechanically loaded and can therefore be easily damaged.

The abstract of JP 08048146 A discloses an arrangement for a car, in which a cable harness is divided into two separate parts. A moving connection is located between the two parts and, between the body and a door of the car, contains a helically wound cable harness within a folding bellows. The two ends of this cable harness end in plug connectors, to each of which a part of the cable harness of the car is connected.

In the known arrangement according to US 2002/112320 A1 which was mentioned in the introduction, the cable harness is likewise divided into two parts, one of which is provided on the body of a car and the other of which is provided on a door of the said car. A cable harness is present within a hinge of this arrangement and runs in the region of the axis of rotation of the hinge within a tube parallel to the said axis of rotation. The two ends of the lines of this cable harness are connected to contact elements of plug connectors which are designed as pins and are fixed in the hinge itself. Mating contacts, which are provided at the ends of the two parts of the cable harness, can be plugged onto the contact elements.

OBJECTS AND SUMMARY

The invention is based on the object of designing the arrangement described in the introduction in such a way that the two units of the cable harness can be connected to one another in a simple manner.

According to the invention, this object is achieved in that the contact elements are in the form of wire-like metal contacts which are made from resilient material, are designed as helices having at least one turn and on which, at each of the two ends, mating contacts which are connected to the lines of the units can be plugged.

In this arrangement, the lines of the cable harness of a car are divided into two parts in the pivot region between the body and the door, each of these two parts being connected to the contact elements of the contact carrier which is located there, and thus being connected to one another. The cable harness or its lines are therefore no longer mechanically loaded by the pivoting movement of the door. Each contact element is designed as a helix having at least one turn. The helix ensures that the ends of a contact element can be moved to and fro through an angle of approximately 150°, without the said contact element remaining deformed, when the door is completely opened and closed again. The contact carrier is therefore constructed in such a way that it and its contact elements can also execute the pivoting movement of the door. The said contact carrier is designed for this specific use so that it can fulfil its function as a rotatable and/or pivotable connection over a long period of time. In this case, the position of the connection points or ends of the contact elements, which are used to connect the lines of the two parts of the cable harness, remain unchanged in each position of the door, so that the lines are not mechanically loaded by the pivoting movements of the door at these connection points either. As a result of the division of the cable harness provided in this arrangement, the respective door can be cabled in advance, so that the lines which are located in the door and are connected to the corresponding loads only need to be connected to the contact elements of the similarly premounted contact carrier after the door is mounted on the body of the car.

To this end the present invention provides for which are provided in a motor vehicle, in which arrangement a number of electrical lines, which corresponds to the number of loads, are combined in at least two units which are connected to one another and, at one end, are connected to a voltage source which is located in the motor vehicle and, at the other end, are connected to the loads, with the loads being provided both on the body of the motor vehicle and on at least one moving part of the said motor vehicle, this part being connected to the body such that it can pivot about an axis of rotation, and in which arrangement at least one contact carrier having a number of contact elements, which are isolated from one another and are made from a highly conductive metal, is provided in the region of the axis of rotation, it being possible for this contact carrier to follow a pivoting movement of the moving part, and for the lines which are connected to the voltage source to be electrically conductively connected to the contact elements of the said contact carrier at one end, and for the lines which lead to the loads of the moving part to be electrically conductively connected to the contact elements of the said contact carrier at the other end.

BRIEF DESCRIPTION OF THE DRAWINGS

Exemplary invention embodiments of the subject matter of the are illustrated in the drawings, in which.

DETAILED DESCRIPTION

Figure 1:
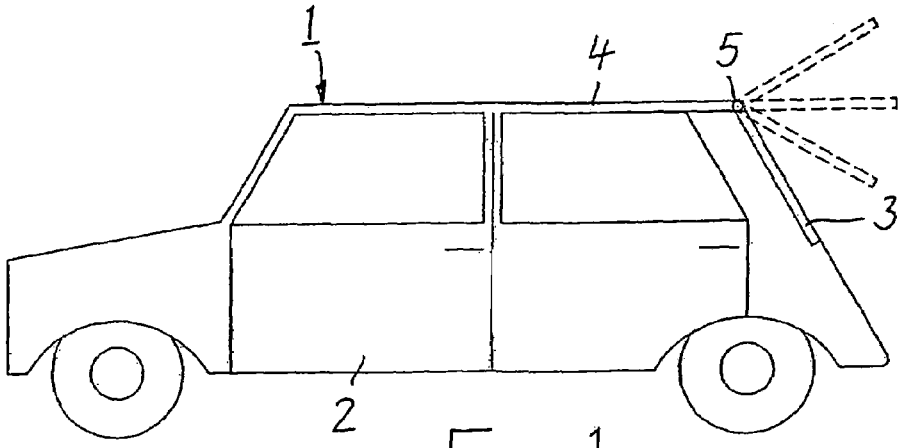
FIG. 1 shows a schematic side view of a car which is equipped with a tailgate.
Figure 2:
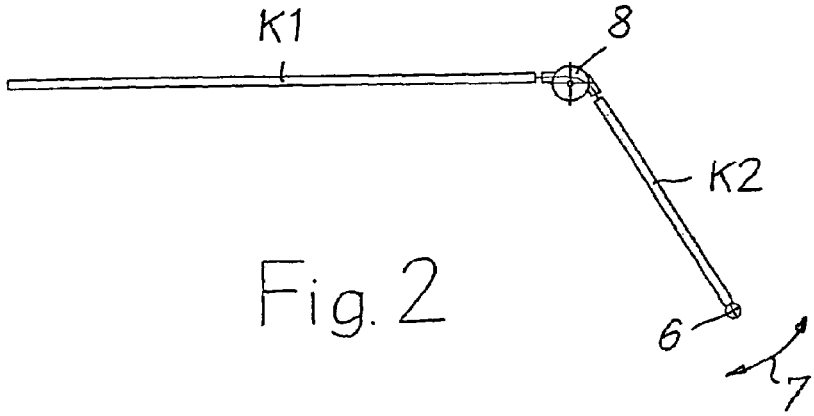
FIG. 2 shows a more precise illustration of a detail from FIG. 1.

FIG. 1 schematically illustrates a side view of a car 1 which, in this exemplary embodiment, is equipped with four doors 2 and one door 3 which is designed as a tailgate. Parts and equipment of the car 1 which are required for operation of the latter are not explained in any detail here. They are known in principle. It is also known that loads, for example headlamps and rear lights, are supplied with power by means of so-called cable harnesses. This invention therefore does not describe the structure of a cable harness either, in which cable harness a number of electrical lines, which corresponds to the number of loads, are combined to form one unit.

The door 3 is connected to the body 4 of the car 1 such that it can pivot, to be precise by means of a hinge in an axis of rotation 5, for example. The said door can be pivoted out of the closed position illustrated in FIG. 1 and into the open positions, which are shown in dashed lines, about the axis of rotation 5. In order to be supplied with power, a load 6 which is arranged on or in the door 3 can be connected to the battery of the car 1 by means of a cable harness which is equipped with electrical lines. This connection must not be interrupted, even if the door 3 is very frequently pivoted about the axis of rotation S in the direction of the double-headed arrow 7.

In the arrangement according to the invention, the cable harness is divided into two units K1 and K2 in the region of interest here. The unit K1 of the cable harness is fixed to the body 4 of the car. It contains a number of electrical lines which, at one end, are connected to the battery of the car, for example. The unit K2 of the cable harness is mounted in the door 3. It preferably has a number of electrical lines which corresponds to the number of loads present in or on the door 3. One of these lines is connected to the load 6.

At least one contact carrier 8 having contact elements 9 is arranged between the two units K1 and K2 of the cable harness, and the lines of the unit K1 of the cable harness are connected to the said contact elements at one end, and the lines of the unit K2 of the said cable harness are connected to the said contact elements at the other end. The contact carrier 8 and its contact elements 9 are constructed in such a way that it or they can also execute a pivoting movement of the door 3 over a long period of time without being damaged. To this end, the contact carrier 8 is mounted in the axis of rotation 5, to be precise advantageously on a hinge located there.

Figure 6:
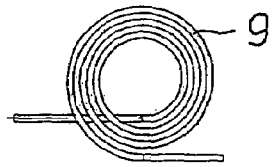
FIG. 6 shows a contact element of the contact carrier.

According to FIG. 6, each contact element 9 is designed in the form of a helix having at least one turn. The helix ensures that the ends of a contact element 9 can be moved to and fro through an angle of approximately 150°, without the said contact element remaining deformed, when the door 3 is completely opened and closed again. The more turns the helix has, the more favourable is its effect. Three turns are illustrated in FIG. 6. However, the number of turns is limited on account of the contact carrier 8 having the smallest possible dimensions.

The contact carrier 8 is advantageously composed of a mechanically stable plastic, such as polybutylene terephthalate (PBT) or polycarbonate (PC). It is fitted with a number of contact elements 9 which are isolated from one another. There should be at least two contact elements 9. In the illustrated exemplary embodiments, the contact carrier 8 comprises a plurality of discs 10 which are composed of an isolating material and are provided axially next to one another on a shaft 11, for example. Each disc 10 is separated from adjacent discs by an insulating material 10*a*, and preferably has one contact element 9.

The contact elements 9 are composed of a highly conductive metal, such as stainless steel, bronze, brass, copper or a copper alloy. They are in the form of wines and have resilient properties. Following installation of the contact cannier 8, the contact elements 9 point in the direction of the unit K1 of the cable harness at one end, and in the direction of the unit K2 of the said cable harness at the other end.

Figure 3:
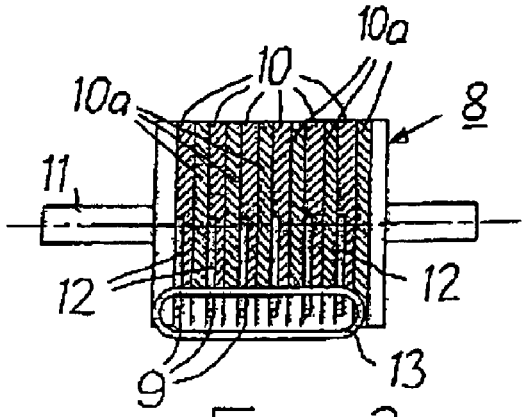
FIG. 3 shows a front view of a contact carrier which can be used in the arrangement according to the invention.
Figure 4:
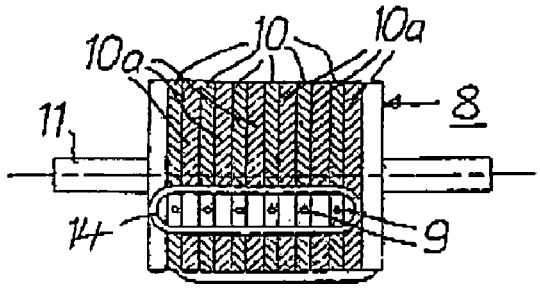
FIG. 4 shows a rear view of the contact carrier from FIG. 3.
Figure 5:
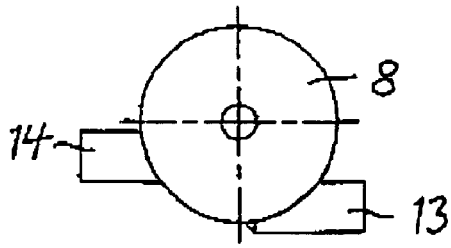
FIG. 5 shows a side view of the contact carrier from FIGS. 3 and 4.

According to FIG. 3, in order to enable the contact elements 9 to move in the contact carrier 8, the discs 10 may be provided with slots 12, which run in the circumferential direction, at least in one of the regions at which the ends of the contact elements 9 protrude out of the contact carrier 8. However, the discs 10 themselves may also be arranged in the contact carrier 8 such that they can rotate about the shaft 11 in the circumferential direction. Slots 12 are not required in this embodiment. According to FIGS. 3 and 4, the ends of the contact elements 9 protrude out of the contact carrier 8 on two different sides to such an extent that they are available for electrical contact-connection purposes. To this end, the ends of the contact elements 9 may be in the shape or form of male connector pins.

In order to plug mating connectors onto the contact elements 9 which are provided on the lines of the units K1 and K2 of the cable harness, the ends of the contact elements 9, which protrude out of the contact carrier 8, may be surrounded by a male connector housing 13 or 14 using a known technique, the said male connector housing being part of the contact carrier 8 and guaranteeing that the contact elements 9 are closed off in a liquid-tight manner. The male connector housings 13 and 14 advantageously also have elements, such as protrusions or recesses, by means of which the mating connectors of the lines of the cable harness which are to be connected can be secured with pressure relief.

In order to complete~the electrically conductive connections between the lines of the units K1 and K2 of the cable harness, the contact carrier 8 is first mounted in the axis of rotation 5 of the car. The mating connectors of the lines of the cable harness are then plugged onto the contact elements 9 in this case, the two units K1 and K2 of the cable harness may advantageously already be premounted, so that it is only necessary for the mating connectors to be inserted into the male connector housing 13 or 14 in order to produce the electrically conductive connections. The mating connectors are then secured in the male connector housings 13 and 14 with strain relief. It is particularly advantageous to premount the door 3 on cable it in advance.

In the preceding text, the arrangement according to the invention is explained for the door 3 (tailgate) of the 20 car. In addition, it can analogously also be used in each of the other doors of the car.

What is claimed is:

1. Arrangement for supplying power to loads in a motor vehicle, comprising:

a voltage source located in said motor vehicle;

at least one load provided on at least one moving part of said motor vehicle;

a number of electrical lines, corresponding to the number of said at least one load, wherein said electrical lines connect said voltage source to said at least one load, and said electrical lines are combined in at least two units which are connected to one another, and wherein said at least one moving part is connected to the body of said motor vehicle such that it can pivot about an axis of rotation;

at least one contact carrier having a number of contact elements, wherein said contact elements are made from a highly conductive metal and are isolated from one another by discs of insulating material, wherein said at least one contact carrier is provided in the region of said axis of rotation and follows the pivoting movement of said at least one moving part, wherein said electrical lines which are connected to said voltage source are electrically conductively connected to said contact elements at one end of the contact carrier, and said electrical lines which are connected to said at least one loads on said at least one moving part of the vehicle are electrically conductively connected to said contact elements on the other end of said contact carrier, wherein said contact elements are in the form of wire-like metallic contacts which are made from resilient material, and are designed as helices having at least one turn, and on which, at each of the two ends, mating contacts can be plugged directly to connect to the lines of said units.

2. Arrangement according to claim 1, wherein the ends of the contact elements are surrounded by a male connector housing.

3. Arrangement according to claim 2, wherein mating contacts which can be plugged onto the contact elements can be secured in the male connector housings with strain relief.

* * * * *